US007896661B2

(12) United States Patent
Yao et al.

(10) Patent No.: US 7,896,661 B2
(45) Date of Patent: Mar. 1, 2011

(54) CARD EDGE CONNECTOR WITH IMPROVED SOLDERING PORTIONS OF TERMINALS

(75) Inventors: Ze-Lin Yao, Kunshan (CN); Zhuang-Xing Li, Kunshan (CN); Xue-Wu Bu, Kunshan (CN); Wen-Jun Tang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/570,183

(22) Filed: Sep. 30, 2009

(65) Prior Publication Data

US 2010/0317234 A1 Dec. 16, 2010

(30) Foreign Application Priority Data

Jun. 11, 2009 (CN) ..... 2009 2 0304310
Jun. 11, 2009 (CN) ..... 2009 2 0304311

(51) Int. Cl.
*H01R 12/00* (2006.01)

(52) U.S. Cl. ..... 439/83; 439/62

(58) Field of Classification Search ..... 439/83, 439/637, 634, 876, 62
See application file for complete search history.

(56) References Cited

U.S. PATENT DOCUMENTS

| | | | | |
|---|---|---|---|---|
| 3,868,166 | A * | 2/1975 | Ammon | 439/634 |
| 4,795,374 | A * | 1/1989 | Rishworth et al. | 439/634 |
| 5,052,936 | A | 10/1991 | Biechler et al. | |
| 5,137,454 | A * | 8/1992 | Baechtle | 439/62 |
| 5,154,634 | A | 10/1992 | Brown et al. | |
| 5,496,180 | A * | 3/1996 | Fabian et al. | 439/60 |
| 6,206,706 | B1 * | 3/2001 | Lee et al. | 439/74 |
| 6,979,228 | B2 * | 12/2005 | Zhang | 439/660 |
| 7,604,510 | B2 * | 10/2009 | Akama et al. | 439/637 |
| 2005/0101190 | A1 | 5/2005 | Ong et al. | |
| 2007/0010125 | A1 | 1/2007 | Regnier et al. | |

* cited by examiner

*Primary Examiner*—T C Patel
*Assistant Examiner*—Harshad C Patel
(74) *Attorney, Agent, or Firm*—Wei Te Chung; Andrew C. Cheng; Ming Chieh Chang

(57) ABSTRACT

A card edge connector includes an elongated insulative housing, a plurality of first terminals, a plurality of second terminals retained in the insulative housing. The insulative housing defining a central slot, a first side wall, and a second side wall opposite to the first side wall. The first terminals each defines a first level soldering portion extend out of the first side wall in a width direction of the insulative housing. The second terminals each defines a second level soldering portion merely under the insulative housing to closer to the first soldering portions for occupying less area of a mother board.

18 Claims, 9 Drawing Sheets

CARD EDGE CONNECTOR WITH IMPROVED SOLDERING PORTIONS OF TERMINALS

BACKGROUND OF THE INVENTION

1. Field of the Invention

The present invention relates to a card edge connector, more particularly to a card edge connector with improved soldering portions of terminals.

2. Description of Related Art

Card edge connectors are widely used in computers for electrically connecting a daughter board to a mother board. Such card edge connector comprises an elongated insulative housing, and a plurality of terminals retained in the insulative housing. The insulative includes a first side wall, a second side wall opposite to the first side wall, and a central slot located between the first side wall and the second side wall. The terminals include a first row of terminals arranged along a lengthwise direction of the insulative housing, and a second row of terminals arranged along the lengthwise direction of the insulative housing.

The first terminals each includes a fixing portion retained in the first side wall, a contact portion protruding into the central slot from the fixing portion, and a first level soldering portion extending out of the insulative housing from the fixing portion to be mounted to the mother board. The second terminals each includes a fixing portion retained in the first side wall, a contact portion protruding into the central slot from the fixing portion, and a second level soldering portion extending out of the insulative housing from the fixing portion to be mounted to the mother board. The first soldering portions of the first terminals and the second soldering portions of the second terminals extend reversely to each other respectively out of the insulative housing in a width direction of the insulative housing. Thereby, the first soldering portions and the second soldering portions would occupy more area of the mother board.

Hence, an improved card edge connector with improved card restriction structure is needed to solve the problem above.

BRIEF SUMMARY OF THE INVENTION

According to one aspect of the present invention, a card edge connector defining a mounting surface adapted for mounting to a mother board, and comprising: an elongated insulative housing defining an upper mating face opposite to the mounting surface, a central slot recessed from the mating face for receiving a daughter board, a first side wall with a plurality of first passages, and a second side wall with a plurality of second passages and opposite to the first side wall, the first passages and the second passages each in communication with the central slot, the central slot located between the first side wall and the second side wall, and defining a central line along a middle portion thereon in a vertical direction of the insulative housing; a plurality of first terminals arranged in one row along a lengthwise direction of the insulative housing, the first terminals each having a first fixing portion retained in the first passage, a first contact portion protruding from the first fixing portion and extending into the central slot, and a first soldering portion located in the mounting surface; and a plurality of second terminals arranged in another row along the lengthwise direction of the insulative housing, the second terminals each having a second fixing portion retained in the second passage, a second contact portion protruding from the second fixing portion and extending into the central slot from the second fixing portion, and a second soldering portion located in the mounting surface; wherein the central line is disposed between the first fixing portions and the second fixing portions, the first soldering portions extend leftwardly and far from the central line from the first fixing portions in a width direction of the insulative housing, the second soldering portions extend leftwardly and toward the central line from the second fixing portions in the width direction of the insulative housing.

According to another aspect of the present invention, a card edge connector defining a mounting surface adapted for mounting to a mother board, and comprising: an elongated insulative housing defining an upper mating face opposite to the mounting surface, a central slot recessed from the mating face for receiving a daughter board, a first side wall with a plurality of first passages, and a second side wall with a plurality of second passages and opposite to the first side wall, the first passages and the second passages each in communication with the central slot, the central slot located between the first side wall and the second side wall, and defining a central line along a middle portion thereon in a vertical direction of the insulative housing; a plurality of first terminals arranged in one row along a lengthwise direction of the insulative housing, the first terminals each having a first fixing portion retained in the first passage, a first contact portion protruding from the first fixing portion and extending into the central slot, and a first soldering portion located in the mounting surface; and a plurality of second terminals arranged in another row along the lengthwise direction of the insulative housing, the second terminals each having a second fixing portion retained in the second passage, a second contact portion protruding from the second fixing portion and extending into the central slot, and a second soldering portion located in the mounting surface; wherein the central line is disposed between the first fixing portions and the second fixing portions, all the first soldering portions and the second soldering portions extend far from the central line from the first fixing portions and the second fixing portions respectively in a width direction of the insulative housing, the first soldering portions partially extending beyond the first wall in the width direction of the insulative housing, the second soldering portions are merely located under the insulative housing.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
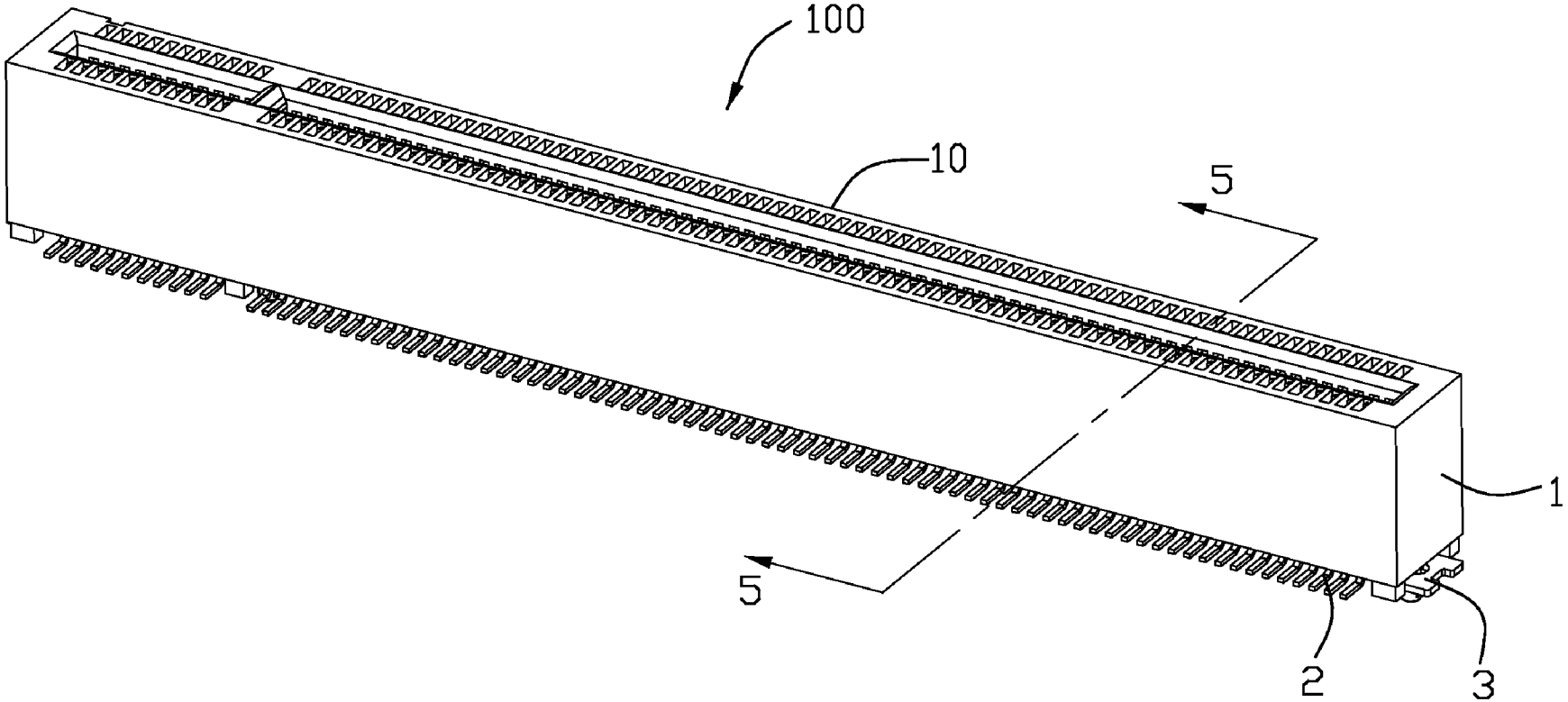
FIG. 1 is a perspective view of a card edge connector in accordance with a first embodiment of the present invention.
Figure 2:
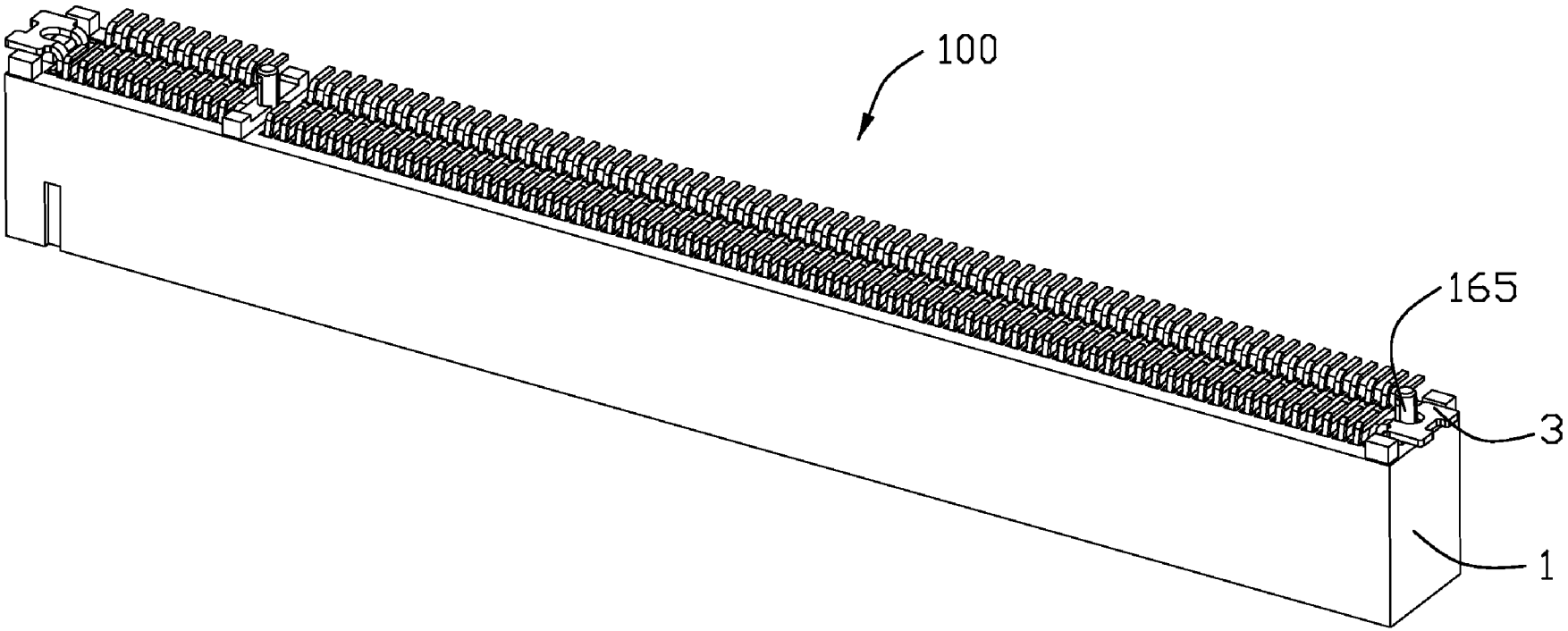
FIG. 2 is another perspective view of the card edge connector shown in the FIG. 1.
Figure 3:
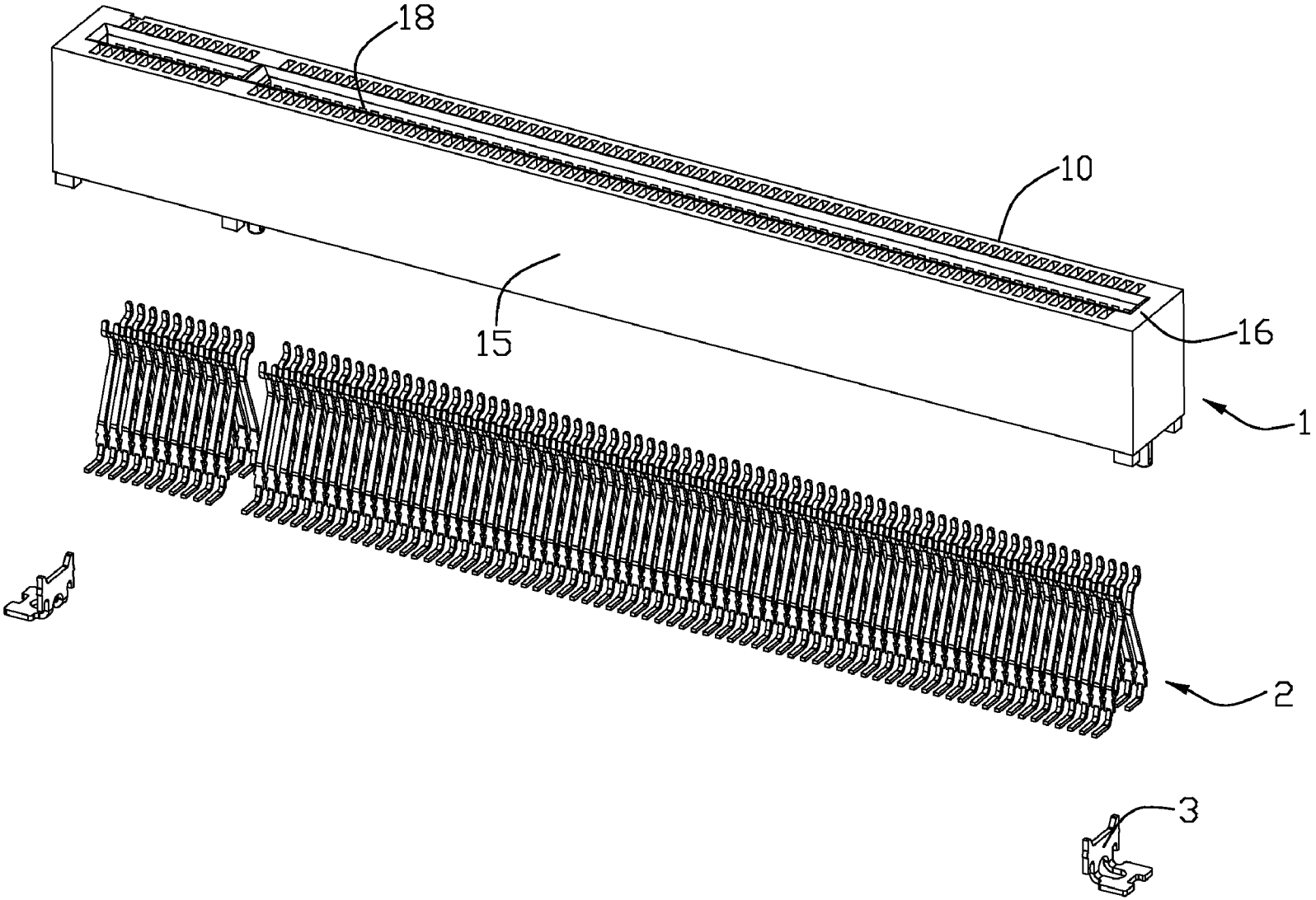
FIG. 3 is an exploded view of the card edge connector shown in the FIG. 1.
Figure 4:
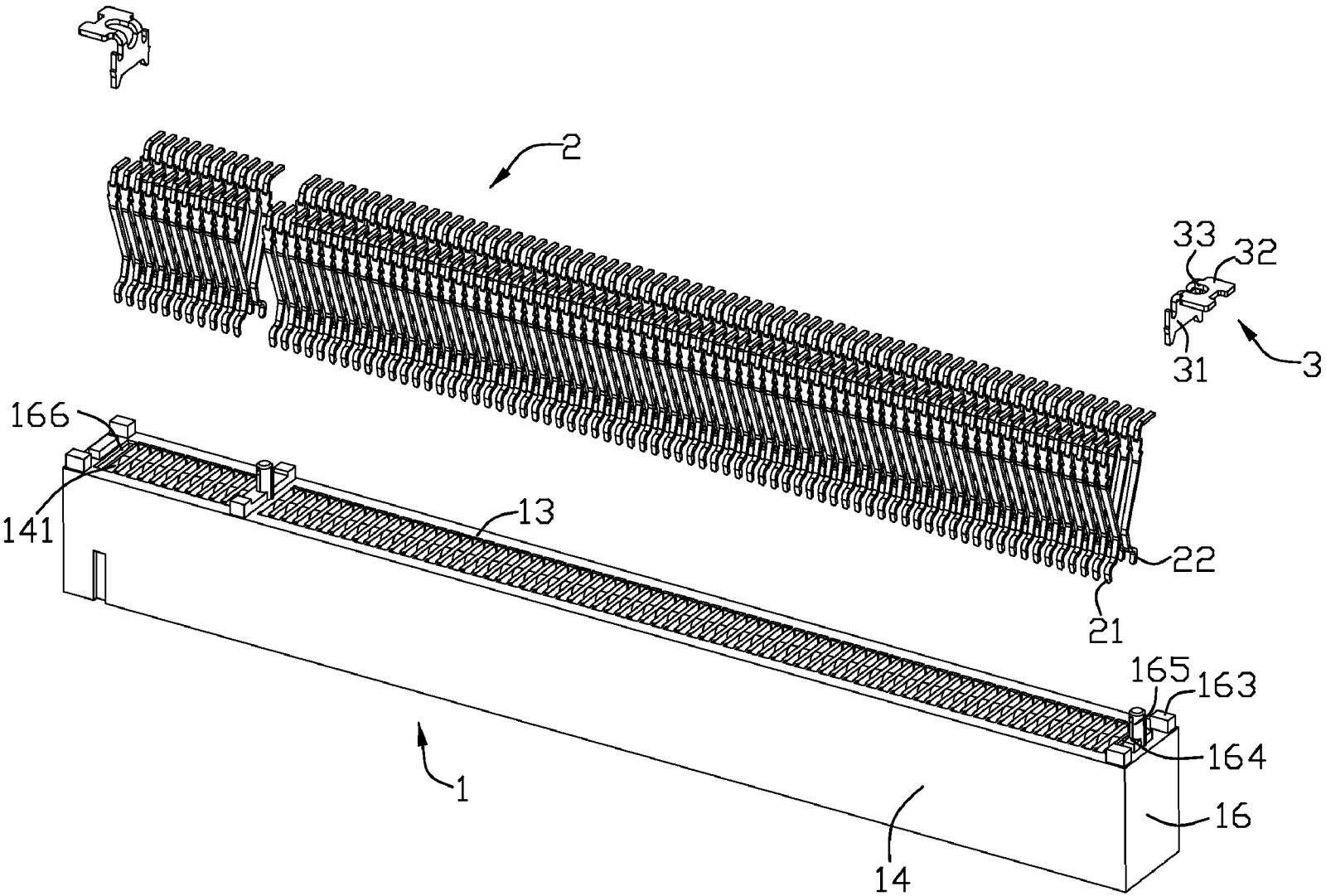
FIG. 4 is another exploded view of the card edge connector shown in the FIG. 1.
Figure 5:
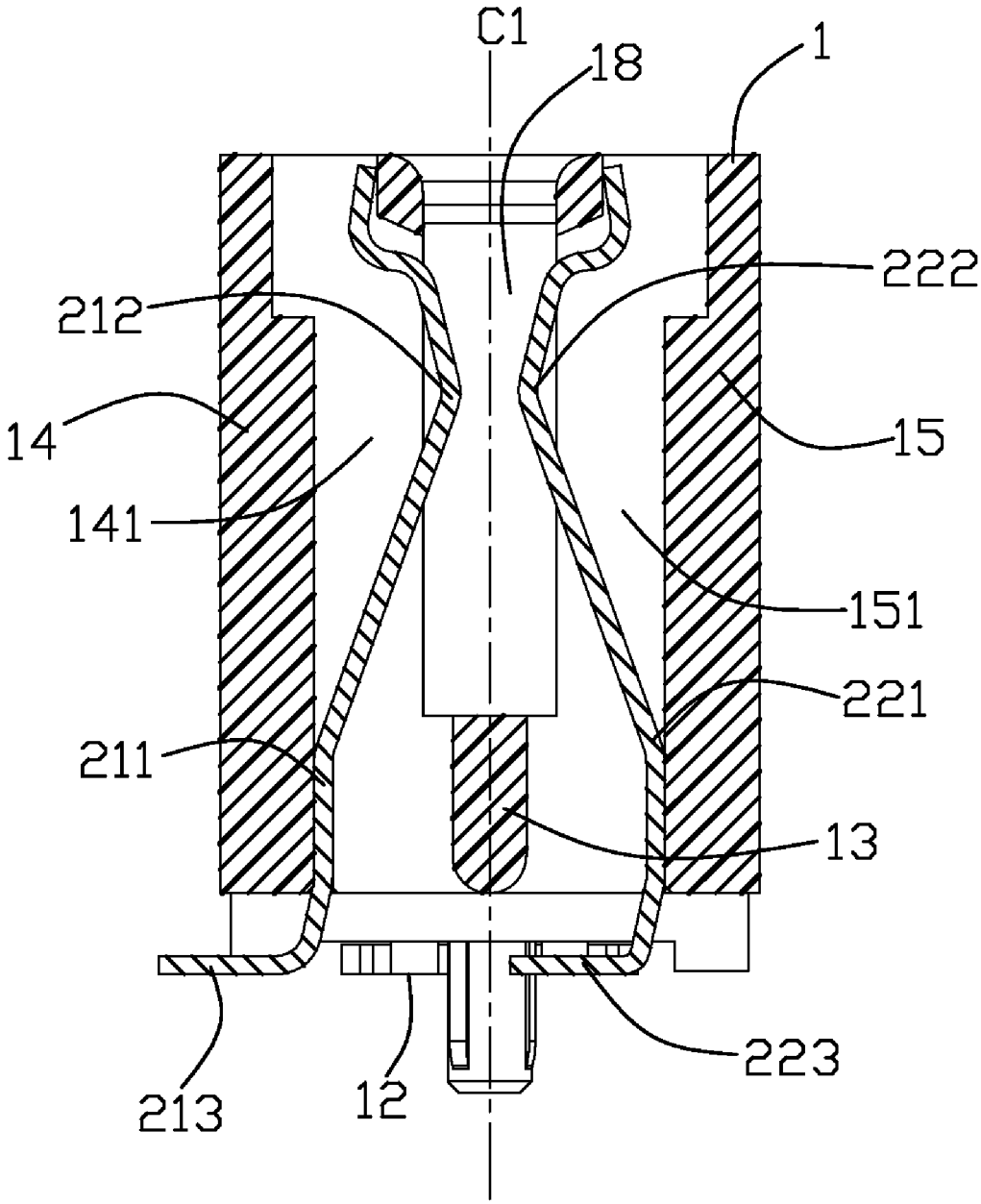
FIG. 5 is a cross-sectional view of the card edge connector along line 5-5 of FIG. 1.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

With reference to FIGS. 1-5, a card edge connector 100 in accordance with a first embodiment of the present invention, which is adapted for mounting on a mother board (not shown) and receiving a daughter card (not shown), and defines a mounting surface 12 adapted for mounting to the mother board, and comprises: an elongated insulative housing 1, a plurality of conductive terminals 2 retained in the insulative housing 1, and a pair of metal mounting pads 3 fixed on opposite bottom end portions of the insulative housing 1. The terminals 2 are divided into a row of first terminals 21 arranged along a lengthwise direction of the insulative housing 1, and another row of second terminals 22 arranged along the lengthwise direction of the insulative housing 1.

The insulative housing 1 defines an upper mating face 10 opposite to the mounting surface 12, a first side wall 14, a second side wall 15 opposite to the first side wall 14, a middle wall 13 connecting between the side walls 14, 15, a pair of end walls 16 connecting ends of the side walls 14, 15 and the middle wall 13 respectively, a central slot 18 recessed from the mating face 10 for receiving the daughter board, and a central line C1 along a middle portion of the central slot 18 and the middle wall 13 in a vertical direction thereof. The first side wall 14 defines a plurality of first passages 141 corresponding to the first terminals 21 and each in communication with central slot 18. The first passages 141 each extends downwardly through the first side wall 14. The second side wall 15 defines a plurality of second passages 151 corresponding to the second terminals 22 and each in communication with central slot 18. The second passages 151 each extends downwardly through the first second wall 15. The first passages 141 and the second passages 151 are symmetric with each other relative to the central line C1.

The end walls 16 each defines a pair of protrusion blocks 163 extending downwardly from opposite side ends thereof, a projection 164 extending downwardly from a bottom portion thereof and located in the middle of the pair of protrusion blocks 163, a located post 165 extending downwardly from a bottom surface of the projection 164 to be received in a mounting hole of the mother board, a retaining depression 166 recessed from a bottom surface thereof. The mounting surface 12 and the bottom surface of the protrusion block 163 are disposed in a level surface. The pair of mounting pads 3 each includes a vertical retaining plate 31 retained into the retaining depression 166, a soldering level plate 32 bending vertically and extending beyond the insulative housing 1 along the lengthwise direction of the insulative housing 1, and a through hole 33 formed on the soldering plate 32 and retained with the located post 165.

The first terminals 21 each includes a first fixing portion 211 retained in the first passage 141 of the insulative housing 1, an first arc contact portion 212 extending from an upper portion of the first fixing portion 211 and protruding into the central slot 18 for contacting the daughter board, and a first level soldering portion 213 bending and extending from a lower portion of the first fixing portion 211 for mounting to the mother board. The lower portions of the first fixing portions 211 are spaced from the middle wall 13 and abut against an inner side wall of the first side wall 14. The first soldering portions 213 extend from the first fixing portion 211 far from the central line C1. The first soldering portions 213 partially extend out of the first side wall 14 in a width direction of the insulative housing 1.

The second terminals 22 each includes a second fixing portion 221 retained in the second passage 151 of the insulative housing 1, an second arc contact portion 222 extend from an upper portion of the second fixing portion 221 and protruding into the central slot 18 for contacting the daughter board, and a second level soldering portion 223 bending and extending from a lower portion of the second fixing portion 221 for mounting to the mother board. The lower portions of the second fixing portions 221 are located in the second passages 151 and abut against an inner side wall of the second side wall 14. The middle wall 13 is disposed in middle of a space between the lower portions of the first fixing portions 211 and the lower portion of the second fixing portions 221. The second soldering portions 223 partially extend form the second fixing portion 221 toward the central line C1 in the width direction of the insulative housing 1. The second soldering portions 223 are merely located under the insulative housing 1 and closer to the first soldering portions 213 for occupying less area of the mother board. The second soldering portions 223 not pass over the central line C1. All the soldering portions 213, 223 of the terminals 2 are arranged in the mounting surface 12. The first terminals 21 and the second terminals 22 are merely located opposite sides of the central line C1.

Figure 6:
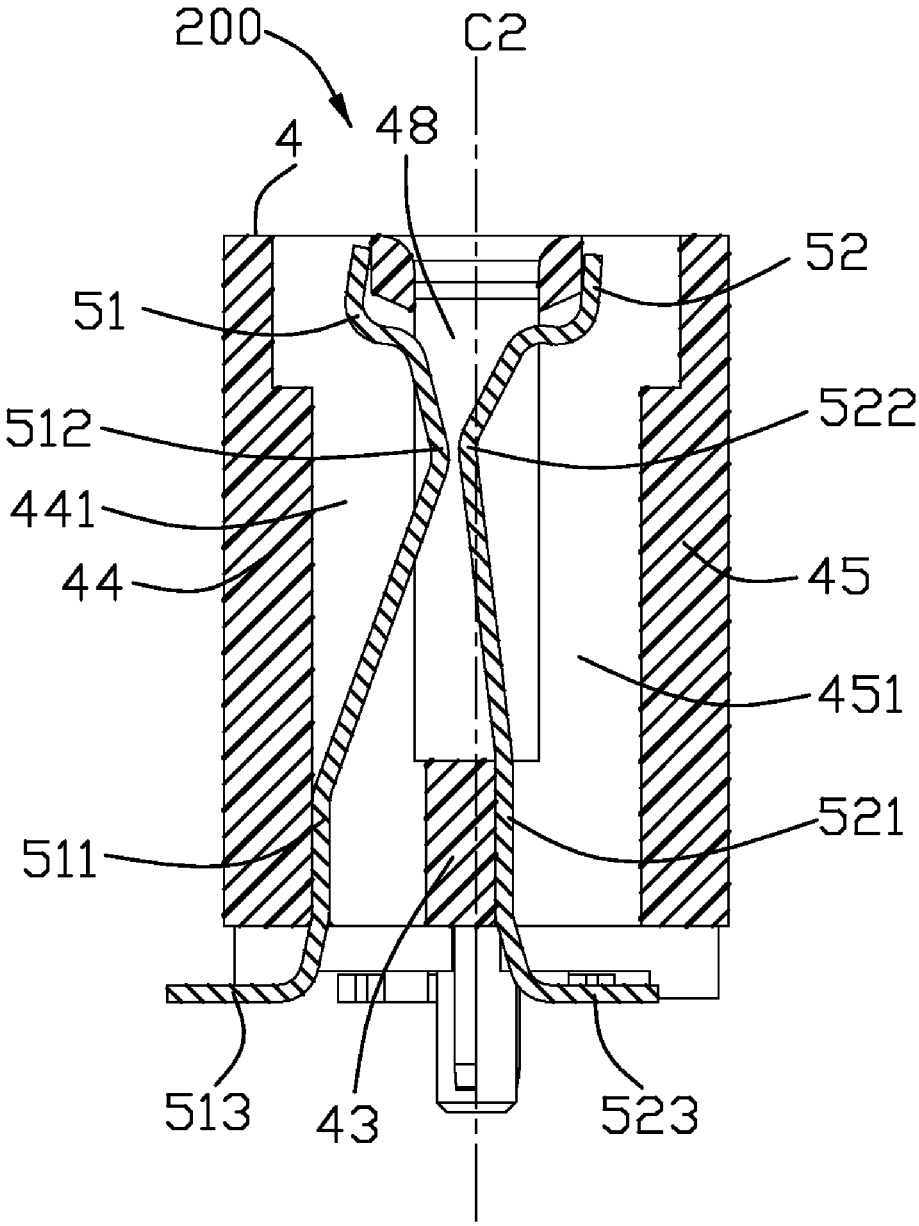
FIG. 6 is a cross-sectional view of a card edge connector in accordance with a second embodiment of the present invention.

With reference to FIG. 6, a card edge connector 200 in accordance with a second embodiment of the present invention. The card edge connector 200 also include an elongated insulative housing 4, a plurality of first terminals 51 and second terminals 52 both retained in the insulative housing 4. The insulative housing 4 defines a first side wall 44, a second side wall 45 opposite to the first wall 44, a middle wall 43 connecting between the side walls 44, 45, a central slot 48 recessed between the side walls 44, 45, and a central line C2 along a middle portion of the central slot 48 and the middle wall 43 in a vertical direction thereof. The first side wall 44 defines a plurality of first passages 441 corresponding to the first terminals 51. The second side wall 45 defines a plurality of second passages 451 corresponding to the second terminals 52. The first terminals 51 each includes a fixing portion 511 retained in the first passages 441, and a first contact portion 512 protruding into the central slot 48 from an upper portion of the first fixing portion 511, and a first soldering portion 513 bending and extending from a lower portion of the first portion 511 for being mounted to the mother board. The lower portions of the first portions 511 are located in the first passages 441 and abut against an inner side wall of the first side wall 44. The first soldering portions 513 partially extend out the first side wall 44 along a width direction of the insulative housing 4. The insulative housing 4 and the first terminals 51 are the same as that of the first embodiment, so detailed description is omitted hereinafter.

The second terminals 52 of the card edge connector 100 are different from the second terminals 22 of the card edge connector 100 in accordance with the first embodiment. Reference to FIG. 6, the second terminals 52 each includes a fixing portion 521 retained in the second passages 451, and a second contact portion 522 protruding into the central slot 48 and extending from an upper portion of the second fixing portion 521, and a second soldering portion 523 bending and extending from a lower portion of the second portion 521 for being mounted to the mother board. The second contact portions 522 extend leftwardly over the central line C2. The second soldering portions 523 extend from the lower portion of the second fixing portion 521 rightward far from the central line C2 along the width direction of the insulative housing 4. The second soldering portions 523 are merely located under the insulative housing 1 and closed to the first soldering portions 513 for occupying less area of the mother board. The lower portions of the second fixing portions 521 are located in the second passages 451 and abut against the middle wall 4.

Figure 7:
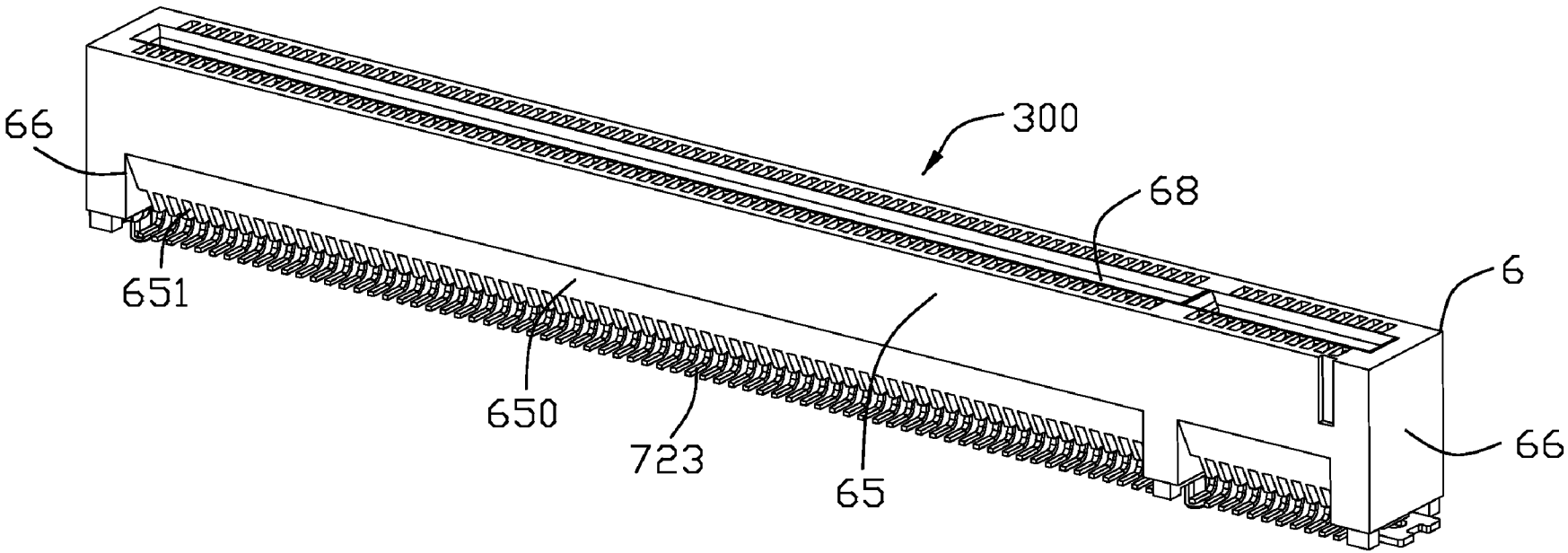
FIG. 7 is a perspective view of a card edge connector in accordance with a third embodiment of the present invention.
Figure 8:
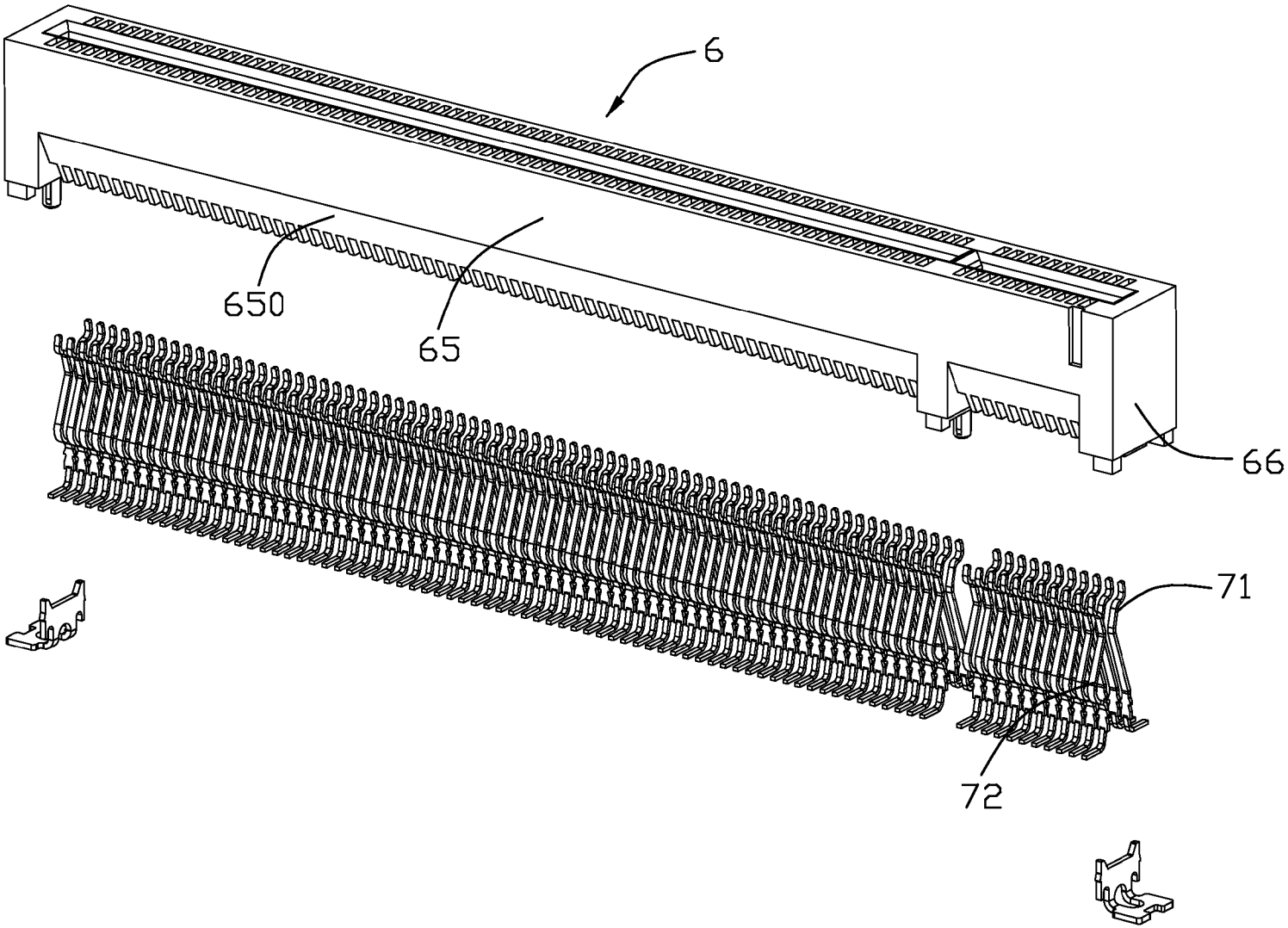
FIG. 8 is an exploded view of the card edge connector shown in the FIG. 7.
Figure 9:
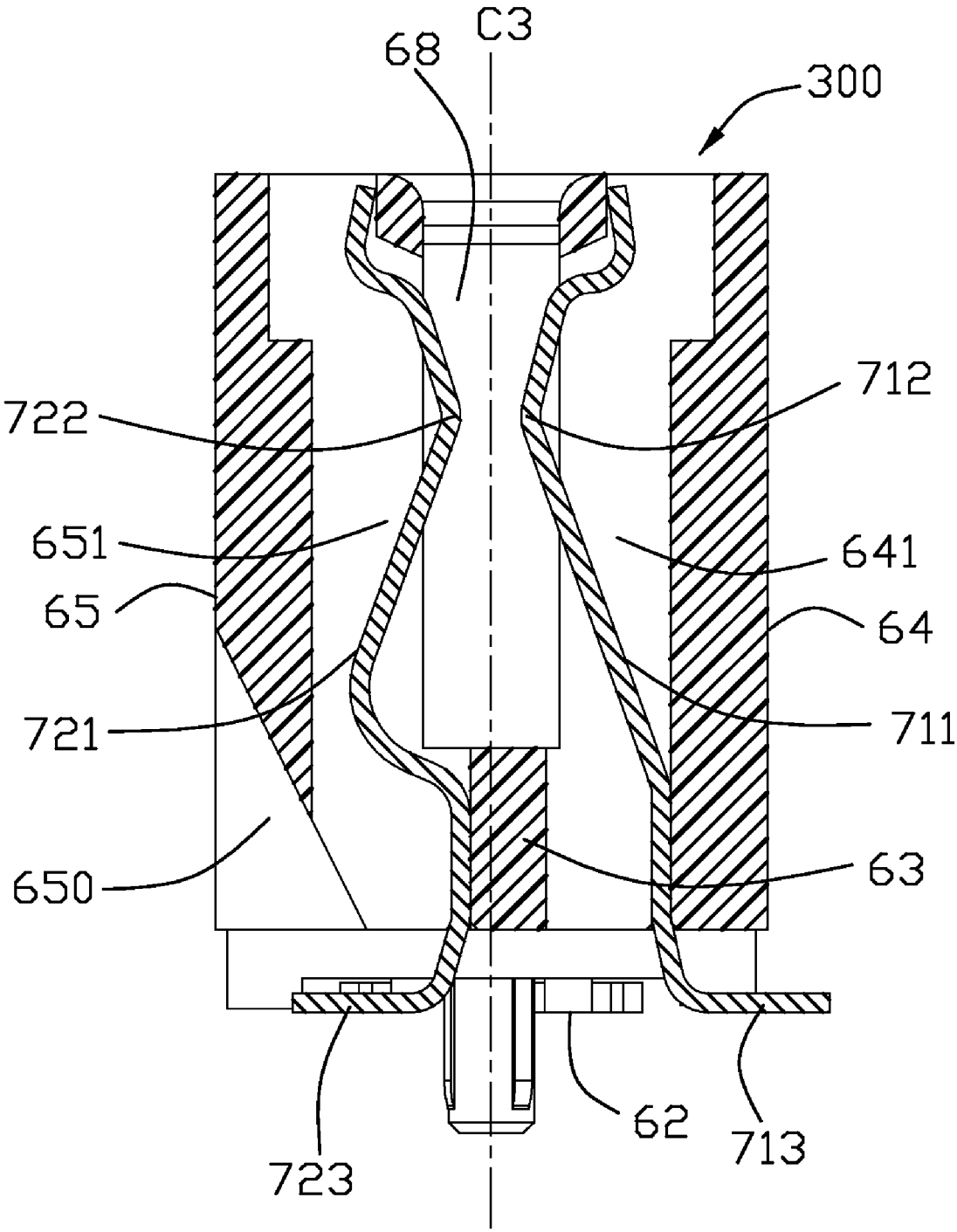
FIG. 9 is a cross-sectional view of the card edge connector shown in the FIG. 7.

With reference to FIGS. 7-9, a card edge connector 300 in accordance with a third embodiment of the present invention. The card edge connector 300 also includes an elongated insulative housing 6, a plurality of first terminals 71 and second terminals 72 retained in the insulative housing 6. The insulative housing 6 includes a bottom mounting surface 62 adapted for mounting to the mother board, a first side wall 64, and a second side wall 65 opposite to the first side wall 64, a middle wall 63 connecting to the side walls 64, 65, a pair of end walls 66 connecting the side walls 64, 65 respectively, a central slot 68 disposed between the side walls 64, 65 and the end walls 66, a central line C3 along a middle portion of the central slot 68 and the middle wall 63 in a vertical direction thereof. The first side wall 64 defines a plurality of first passages 641 corresponding to the first terminals 71. The second side wall 65 defines a plurality of second passages 651 corresponding to the second terminals 72, an outer side surface in an upper-to-lower direction of the insulative housing 6, an open slot 650 recessed upwardly from the mounting surface 62 to the outer side surface to facilitate air flow. The open slot 650 extends parallel to the central slot 68 along a lengthwise direction of the insulative housing 6 and communicate with a bottom portion of the second passages 65. The open slot 650 defines a cross section in a width direction of the insulative housing 6. The cross section is a triangle with one apex located on the outer side surface and another two apexes located in the mounting surface 62 respectively. The open slot 650 and the central slot 68 each is located between the pair of end walls 66 respectively.

The first terminals 71 and the second terminals 72 each includes a fixing portion 711, 721 retained in the insulative housing 6, an arc contact portion 712, 722 protruding into the central slot 68, and a level soldering portion 713, 723 extending out of the insulative housing 6 from the fixing portion 711,721. The soldering portions 713 of the first terminals 71 extending rightwardly out of the first side wall 64 in a width direction of the insulative housing 6. The soldering portions 723 of the second terminals 72 not extend leftwardly out of the second side wall 65 in the width direction of the insulative housing 6 and are disposed merely under the insulative housing 6. The soldering portions 723 of the second terminals 72 are partially exposed in the open slot 650 and exterior while the card edge connector 300 being mounted to the mother board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. A card edge connector defining a mounting surface adapted for mounting to a mother board, and comprising:

an elongated insulative housing defining an upper mating face opposite to the mounting surface, a central slot recessed from the mating face for receiving a daughter board, a first side wall with a plurality of first passages, and a second side wall with a plurality of second passages and opposite to the first side wall, the first passages and the second passages each in communication with the central slot, the central slot located between the first side wall and the second side wall, and defining a central line along a middle portion thereon in a vertical direction of the insulative housing;

a plurality of first terminals arranged in one row along a lengthwise direction of the insulative housing, the first terminals each having a first fixing portion retained in the first passage, a first contact portion protruding from the first fixing portion and extending into the central slot, and a first soldering portion located in the mounting surface; and a plurality of second terminals arranged in another row along the lengthwise direction of the insulative housing, the second terminals each having a second fixing portion retained in the second passage, a second contact portion protruding from the second fixing portion and extending into the central slot from the second fixing portion, and a second soldering portion located in the mounting surface;

wherein the central line is disposed between the first fixing portions and the second fixing portions, the first soldering portions extend leftwardly and far from the central line from the first fixing portions in a width direction of the insulative housing, the second soldering portions extend leftwardly and toward the central line from the second fixing portions in the width direction of the insulative housing, wherein the first soldering portions are aligned with and spaced away from the second soldering portions in the width direction; wherein the first soldering portion are disposed further from the central line than the second soldering portion in the width direction of the insulative housing.

2. The card edge connector as claimed in claim 1, wherein the first soldering portions partially extend out of the insulative in the width direction of the insulative housing, the second soldering portions are merely disposed under the insulative housing in the width direction of the insulative housing.

3. The card edge connector as claimed in claim 2, wherein the insulative housing defines a middle wall between the first passages of the first side wall and the second passages of the second side wall, the second soldering portions are merely located under the insulative housing, and not pass over the central line.

4. The card edge connector as claimed in claim 1, wherein the insulative housing defines a middle wall between the first passages of the first side wall and the second passages of the side wall, both of the first fixing portions and the second fixing portions both each has a lower portion connecting to the soldering portion, the first side wall and the second side wall each defines an inner side wall exposed in the first passages and the second passages respectively, the lower portions of the first terminals and the second terminals are located toward the inner side walls of the first side wall and the second side wall respectively in the width direction of the insulative housing.

5. The card edge connector as claimed in claim 1, wherein the insulative housing defines a middle wall under the central slot and between the first passages and the second passages, the central line is located along a middle portion of the middle wall, the first passages and the second passages are symmetric with each other relative to the central line.

6. A card edge connector defining a mounting surface adapted for mounting to a mother board, and comprising:

an elongated insulative housing defining an upper mating face opposite to the mounting surface, a central slot recessed from the mating face for receiving a daughter board, a first side wall with a plurality of first passages, and a second side wall with defining a plurality of second passages and opposite opposited to the first side wall, the first passages and the second passages each in communication with the central slot, the central slot located between the first side wall and the second side wall, and defining a central line along a middle portion thereon in a vertical direction of the insulative housing;

a plurality of first terminals arranged in one row along a lengthwise direction of the insulative housing, the first terminals each having a first fixing portion retained in the first passage, a first contact portion protruding from the first fixing portion and extending into the central slot, and a first soldering portion located in the mounting surface; and a plurality of second terminals arranged in another row along the lengthwise direction of the insulative housing, the second terminals each having a second fixing portion retained in the second passage, a second contact portion protruding from the second fixing portion and extending into the central slot, and a second soldering portion located in the mounting surface;

wherein the central line is disposed between the first fixing portions and the second fixing portions, all the first soldering portions and the second soldering portions extend far from the central line from the first fixing portions and the second fixing portions respectively in a width direction of the insulative housing, the first soldering portions partially extending beyond the first side wall in the width direction of the insulative housing, the second soldering portions are merely located under the insulative housing, the first soldering portions are aligned with and spaced away from the second soldering portions in the width direction; wherein the first soldering portion are disposed further from the central line than the second soldering portion in the width direction of the insulative housing.

7. The card edge connector as claimed in claim 6, wherein the insulative housing defines a middle wall under the central slot and disposed between the first passages and the second passages, the first fixing portion each defines a first lower portion connecting the first soldering portion, the first lower portions are located in the first passages and abut against an inner wall of the first side wall, the second fixing portion each defines a second lower portion connecting the second soldering portion, the second lower portions are located in the second passages and abut against an inner side wall of the middle wall.

8. The card edge connector as claimed in claim 6, wherein insulative housing defines a middle wall under the central slot and between the first passages and the second passages, the central line is located on a middle portion of the middle wall, the first passages and the second passages are symmetric with each other relative to the central line.

9. The card edge connector as claimed in claim 6, wherein the insulative housing defines a middle wall under the central slot and between the first passages and the second passages, the central line is located on a middle portion of the middle wall, the first passages and the second passages are symmetric relative to the central line.

10. The card edge connector as claimed in claim 9, wherein the open slot defines a bottom portion in communication with the second passages.

11. The card edge connector as claimed in claim 6, wherein the second side wall defines an outer side surface in an upper-to-lower direction thereof, and an open slot recessed upwardly and sidewardly from the mounting surface to the outer side surface, the open slot extends along the lengthwise direction of the insulative housing, the second soldering portions are partially exposed in the open slot.

12. The card edge connector as claimed in claim 11, wherein the open slot defines a cross section in the width direction of the insulative housing, the cross section is a triangle, one apex of the triangle is located on the outer side surface, another two apexes of the triangle are located in the mounting surface.

13. The card edge connector as claimed in claim 11, wherein the insulative housing includes a pair of end walls connecting to the first side wall and the second side wall respectively, the open slot and the central slot each is located between the pair of end walls.

14. A card edge connector comprising:

an insulative elongated housing extending along a longitudinal direction;

a central slot defined in the housing and defining a central line thereof;

opposite first and second rows of passageways disposed in the housing by two sides of the central slot, and beside corresponding first and second side walls, respectively, said first row of passageways being aligned with the second row of passageways in pair in a transverse direction perpendicular to said longitudinal direction;

a plurality of first contacts disposed in the first row of passageways, respectively, each of said first contacts defining a first retention section and a first resilient contacting sections extending from an upper portion of said first retention section with a first contacting point located in the central slot; and a plurality of second contacts disposed in the second row of passageways, respectively, each of said second contacts defining a second retention section and a second resilient contacting section extending from an upper portion of said second retention section with a second contacting point located in the central slot; wherein each of said first contacts further includes a first horizontal solder tail extending from a lower portion of the corresponding first retention section outwardly to away from the central slot while each of said second contacts further includes a second horizontal solder tail extending from a lower portion of the corresponding second retention section and beyond neither of the second side wall and the first side wall in the transverse direction but essentially aligned with the corresponding second passageway in a vertical direction perpendicular to both said longitudinal direction and said transverse direction; wherein the second horizontal solder tail is aligned with and spaced from the corresponding first horizontal solder tail of the same pair in said transverse direction; wherein the first horizontal solder tails are disposed further from the central line than the second horizontal solder tails in the transverse direction.

15. The card connector as claimed in claim 14, wherein the first retention section is located adjacent to the corresponding first side wall while the second retention section is located adjacent to either the central slot or the corresponding second side wall.

16. The card connector as claimed in claim 15, wherein said second retention section is located adjacent to the corresponding second side wall, and the second horizontal solder tail extending inward toward the central slot.

17. The card connector as claimed in claim 16, wherein the housing defines an elongated open slot in a bottom portion of the second side wall for investigation of the second horizontal solder tails.

18. The card connector as claimed in claim 15, wherein said second retention section is located adjacent to the central slot, and the second horizontal solder tail extends outward toward the corresponding second side wall.

* * * * *